United States Patent [19]

Sansone

[11] 4,409,914

[45] Oct. 18, 1983

[54] MULTI-STAGE PRESSER LIFTER DEVICE

[75] Inventor: Eugene A. Sansone, Belle Meade, N.J.

[73] Assignee: The Singer Company, Stamford, Conn.

[21] Appl. No.: 275,186

[22] Filed: Jun. 19, 1981

[51] Int. Cl.[3] ..... D05B 29/02

[52] U.S. Cl. ..... 112/237

[58] Field of Search ..... 112/237, 239

[56] References Cited

U.S. PATENT DOCUMENTS

| | | | |
|---|---|---|---|
| 1,033,997 | 7/1912 | Drake | 112/237 |
| 3,298,341 | 1/1967 | Bonis | 112/239 |
| 3,347,194 | 10/1967 | Hale et al. | 112/237 |
| 3,353,511 | 11/1967 | Marino | 112/237 |
| 4,246,856 | 1/1981 | Sansone et al. . | |

FOREIGN PATENT DOCUMENTS

| | | | |
|---|---|---|---|
| 958879 | 5/1972 | Italy . | |
| 49-39665 | 4/1974 | Japan . | |
| 54-115944 | 9/1979 | Japan . | |
| 55-4434 | 1/1980 | Japan . | |
| 2037827 | 7/1980 | United Kingdom | 112/237 |

*Primary Examiner*—Louis Rimrodt
*Assistant Examiner*—Andrew M. Falik
*Attorney, Agent, or Firm*—Edward P. Schmidt; Robert E. Smith; Edward L. Bell

[57] ABSTRACT

A presser lifting arrangement for an industrial sewing machine having a knee shift device which manually elevates a presser foot to a height above the work fabric to permit free movement of the work fabric therebeneath. Further motion of the knee shift device actuates a snap action switch which operates to connect a solenoid to a source of power to elevate the presser foot to its maximum height. In a second embodiment, the knee shift device includes internal switch contacts which energize a first solenoid to raise the presser foot a distance sufficient to permit free movement therebeneath, and continued actuation of the knee shift pad actuates a snap action switch which energizes a second solenoid to raise the presser foot to its maximum height.

6 Claims, 6 Drawing Figures

MULTI-STAGE PRESSER LIFTER DEVICE

BACKGROUND OF THE INVENTION

This invention is in the field of sewing machines; more particularly, it is concerned with a presser lifter device for a sewing machine.

In industrial stitching, it frequently is necessary for a sewing machine operator to reposition a work fabric preparatory to initiating a line of stitching. In order to effect this repositioning, the sewing machine operator must elevate the presser foot away from the work fabric, reposition the work fabric and then lower the presser foot onto the work fabric in order to observe if the work fabric has been moved to the proper position. One of the difficulties encountered in the prior art devices using pneumatic or electrical presser foot elevating devices, is that repositioning might be required several times before the proper position is achieved, because the guide to the proper positioning, the presser foot, is elevated to its maximum lift, a position which is inappropriate for its guide function.

Also, in certain sewing applications, it is necessary that the presser foot be slightly elevated during most of the stitching cycle. Thus, to apply decorative stitching to a work fabric it is necessary to elevate the presser foot sufficiently to allow for ready repositioning of the work fabric during the stitching cycle. Since the slight elevation of the presser foot may be necessary for long periods of time, it is also desirable that a minimum amount of effort is required by the operator.

What is required is a presser device having a small, readily achievable presser lift for repositioning of a work fabric beneath the presser foot in addition to the capability of elevating the presser foot to its maximum extent with the least additional motion by the sewing operator so as to provide for least interference with other functions performed by the operator. Ideally, the minimum lift for repositioning is achieved with a minimum effort so as to enable a sewing operator to maintain this lift for long periods of time.

SUMMARY OF THE INVENTION

The above requirements have been achieved in a sewing machine in which the full lift of the presser foot is achieved by electrical means, for example, by a solenoid, the electrical means being actuated by a snap action switch adjustably supported on a presser lifter rock shaft. The presser lifter rock shaft is rocked by a manual knee shifter which by way of a foot lift lever attached to the rock shaft, urges a push rod on rotation of the manual knee shifter to initiate the elevation of a presser foot. The snap action switch may have its position on the presser lifter rock shaft adjusted so as to cause actuation thereof to initiate a full presser lift a selected time after the manual knee shifter has elevated the presser foot a sufficient distance for repositioning of the work fabric. Thus, a sewing operator is enabled to slightly elevate the presser foot for repositioning a work fabric while the presser foot is still located close to the work fabric for gauging purposes. Since only a slight elevation of the presser foot is brought about by the manual knee shifter, a minimum force is required and the snap action switch maintained in an adjusted position to actuate full lift by electrical means after a small manual lift is occassioned will insure that the hard part of the presser foot lift will be accomplished by the electrical means, thereby somewhat obviating operator fatigue.

In an alternative design, particularly useful where a small presser lift must be maintained for long periods, a pair of solenoids may be provided. In this embodiment, a first solenoid may be actuated by internal contacts supported in the knee shift pad, to cause a small lift of the presser lifter for embroidery work or for repositioning. Continued rotation of the knee shift pad will actuate a snap action switch adjustably clamped to the presser lifter rock shaft as indicated above so as to maintain a full lift of the presser foot to its maximum height.

DESCRIPTION OF THE DRAWINGS

With the above and additional objects and advantages in mind as will hereinafter appear, the invention will be described with reference to the accompanying drawings in which:

Referring now to FIG. 1, there is shown a sewing machine 10 which is supported in a work table 12 in the usual fashion for industrial sewing machines. The sewing machine 10 includes a bed 14 from one end of which rises a standard 16, which standard supports a bracket arm 18 overhanging the bed and terminating in a sewing head 20. The sewing head 20 supports therein a presser bar 22, which presser bar terminates in a presser foot 24 for urging work fabric against feed dogs 26, part of a feed system (not shown) supported within the bed 14 of the sewing machine. The presser bar 22 is biased downwardly by a coil spring 28, the pressure of which may be adjusted by a regulating screw 30 threadedly carried in the bracket arm 18.

Figures 1, 2, 3A, 3B:
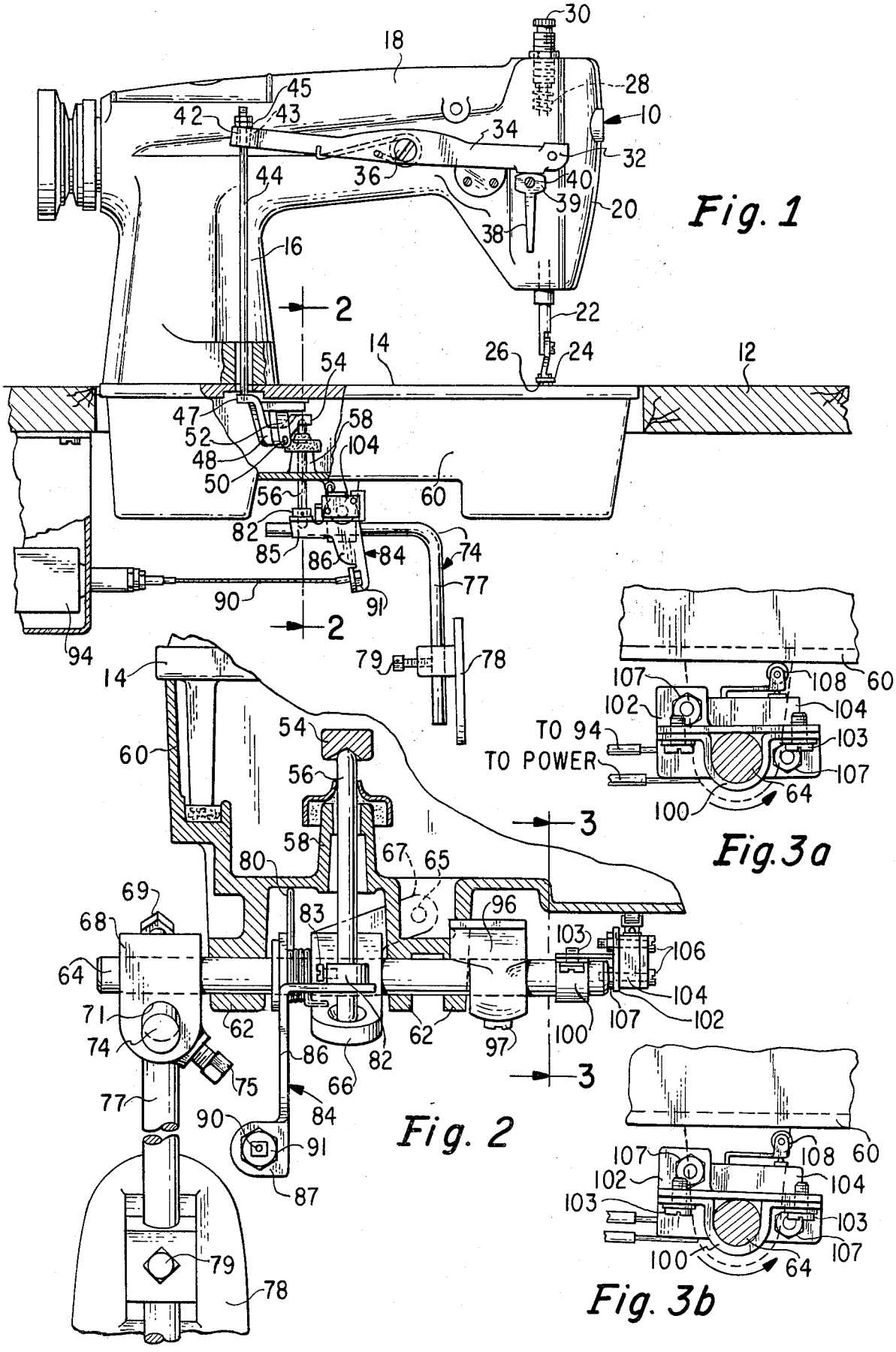
FIG. 1 is a rear elevational view of a sewing machine and work table, partly in cross-section, to which the invention has been applied.
FIG. 2 is a cross-section taken along line 2—2 of FIG. 1.
FIG. 3*a* is a view taken along line 3—3 of FIG. 2 to show the position of the snap action switch actuated for full power lift.
FIG. 3*b* is a view similar to FIG. 3*a* with, however, the snap action switch rotated to a new position for a partial manual lift preceding the power assist.

The presser foot 24 serves, as is well known in the art, to hold work fabrics relatively to the sewing instrumentalities and to maintain the work fabrics in engagement with the feed dogs 26 of the work feeding mechanism (not shown) of the sewing machine 10. It is a requirement of sewing machine operation that the operator be able to raise and lower the presser foot 24 in opposition to the spring 28 in a variety of different ways, for a variety of different reasons. To introduce and remove work fabrics from the stitching instrumentalities it may be desirable to raise the presser foot 24 an appreciable distance to an upper limit. To reposition the work fabric under the presser foot 24 it is desirable to raise the presser foot only a slight amount. Also, to facilitate turning the work fabric at a sharp angle during the sewing process, it may be desirable to raise the presser foot 24 only slightly. In order to accommodate darning or embroidery, it will be necessary to raise the presser foot 24 slightly for extended periods.

For raising and lowering the presser foot 24, the presser bar 22 is operatively connected to one extremity 32 of a lever 34 fulcrummed on a shoulder screw 36 carried by the sewing machine frame. Underlying a lever extremity 32 is an operator influenced cam lever 38 which is fulcrummed on a screw 40 and formed with cam lobes 39 which act to turn the lever 34 to raise and lower the presser foot 24 whenever the operator influenced cam lever is turned.

In order that the presser foot 24 may be raised and lowered by a knee shift device, the opposite extremity 42 of the lever 34 is apertured, as as 43, and accommodates a pull rod 44 on which stop nuts 45 are threaded above the lever extremity 42. The pull rod 44 extends downwardly into the sewing machine frame and is rigidly secured or otherwise fastened to one extremity 47 of a lever 48 which is fulcrummed, as at 50, on a bracket 52 depending beneath the sewing machine bed 14. The opposite extremity 54 of the lever 48 is flattened to provide an abutment for a push rod 56 which is endwise slidable in a bushing 58 formed in a lubricant collecting pan 60 beneath the sewing machine bed 14 (see also FIG. 2).

Journalled in a bracket 62 formed as part of the lubricant collecting pan 60 and located therebeneath, is a rock shaft 64 to which is secured a foot lift lever 66 underlying the push rod 56 (see FIG. 2). On the end of the rock shaft 64 facing a sewing machine operator, a member 68 is affixed as by screw 69. The member 68 is fashioned with a transverse bore 71 therethrough beneath the rock shaft 64, which bore receives a rod 74 which is clamped therein by a second screw 75. The rod 74 is fashioned with a downturned portion 77 to which is adjustably fixed a knee shift pad 78, as by a screw 79. Thus, it is apparent that movement of the knee shift pad 78 to the left as viewed in FIG. 1 will rotate the rock shaft 64 and cause the foot lift lever 66 to elevate the push rod 56 and initiate actuation of the levers 48, 34 which will raise the presser foot 24 out of contact with a work fabric. Return of the foot lift lever 66 and knee shift pad 78 to its initial position is effected by means of a torsion spring 80 (see FIG. 2) which extends between the lubricant collecting pan 60 and the foot lift lever so as to urge the lever to a position which will allow the presser foot 24 to remain in contact with the work fabric.

Further disclosed in FIGS. 1 and 2, the push rod 56 supports thereon a collar 82 held fixed in a selected position by a screw 83. An actuator bell crank 84 is pivotably carried on the rock shaft 64 and is fashioned with a first arm 85 extending beneath the collar 82 and freely encircling the push rod 56. A second arm 86 terminates in a near 87 through which the end of a pull cable 90 extends to be retained in an adjusted length by a nut 91 (see FIG. 1). The opposite end of the pull rod 90 terminates at an actuator which in a preferred mode would be a solenoid 94 indicated in FIG. 1. However, a pneumatic actuator may be used which may be actuated electrically for compatibility with electronic control devices; or pneumatically, utilizing pneumatically operated components where the use of electrical components is to be minimized. Thus, the presser foot 24 might be elevated by use of the knee shift pad 78 which rotates the foot lift lever 66, possibly even rotating the actuator bell crank 84 and causing the ear 87 to slide down the pull cable 90; or the presser foot 24 might be elevated by energizing the solenoid 94, causing the actuator bell crank 84 to rotate and impinge upon the collar 82 and raise the push rod 56. A lug 96 attached to the rock shaft 64 by screw 97 (see FIG. 2) may be positioned to impinge upon the bracket 62 to limit the maximum lift of the presser foot 24. Similarly, an ear extension 67 to the foot lever 66 extends behind the bracket 62 to limit the return motion of the foot lift lever under the influence of the torsion spring 80. A screw 65 may be provided, extending through the ear extension 67 to adjust the return position of the foot lift lever 56.

At the end of the rock shaft 64 opposite that supporting the knee shift pad 78, a U clamp 100 is provided for adjustably supporting a bracket 102 on the end of the rock shaft. A snap action switch 104 is attached to the bracket 102 by screws 106 and nuts 107, screws 103 also being provided to attach the bracket 102 to the U clamp 100 and thereby retain the snap action switch in a selected orientation relative to the lubricant collecting pan 60 as will be explained below.

Referring to FIG. 3*a*, the snap action switch 104 is shown in an actuated position as accomplished by rotation of the rock shaft 64 by the knee shift pad 78. The follower 108 of the snap action switch 104 impinges on the lubricant collecting pan 60, utilized as an abutment, and actuates the snap action switch. The snap action switch 104 is part of a circuit (not shown) supplying the solenoid 94, and actuation of the snap action switch energizes the solenoid. Actuation of the snap action switch 104 will supply power to the solenoid 94, which solenoid will pull on the pull cable 90 and rotate the actuator bell crank 84 clockwise as viewed in FIG. 1 to raise the presser foot 24 by way of the collar 82 affixed to the push rod 56. Energization of the solenoid 94, and raising of presser foot 24 occassioned thereby, has no effect on the knee shift pad 78 whose position is solely under operator control. Referring to FIG. 3*b*, the rock shaft 64 is shown in an unactuated position. It is observed that the follower 108 of the snap action switch 104 is spaced from the lubricant collecting pan 60, and actuation of the knee shift pad 78 may be arranged to provide some manual lift of the push rod 56 prior to impingment of the follower 108 on the lubricant collecting pan 60. The result is that an adjustable degree of lift of the presser foot 24 may be obtained by the actuation of the knee shift pad 78 which will allow repositioning of the work material under the presser foot 24. The amount of lift imparted to the presser foot 24 by way of the knee shift pad 78 is adjustable by angularly repositioning the snap action switch 104 on the rock shaft 64. Thus, by providing a greater clearance between the follower 108 and the lubricant collecting pan 60 the presser foot 24 may be shifted manually to a higher elevation prior to initiation of the full lift by the solenoid 94. This adjustment capability will permit the adjustment of the machine to suit the thickness of fabric being operated upon. By means of this adjustment, a sufficient lift may be obtained to move the work fabric freely beneath the presser foot 24 while still permitting by a small additional motion of the knee shift pad 78, a lift of the presser foot 24 to its maximum elevation by actuation of the snap action switch 104. Further, such a device is amenable to use with electronic control devices for automatically effecting maximum presser lift at the completion of stitching. The small initial lift accomplished by a manual knee shift requires a relatively low force with the higher force required for a maximum lift being effected by the solenoid 94. The small additional motion required to obtain a maximum lift also provides a much greater speed of response than is obtainable with a full manual lift. Thus, the flexibility of a manual lift and the less fatiguing advantages of an electrical lift are retained in one device.

Figure 4:
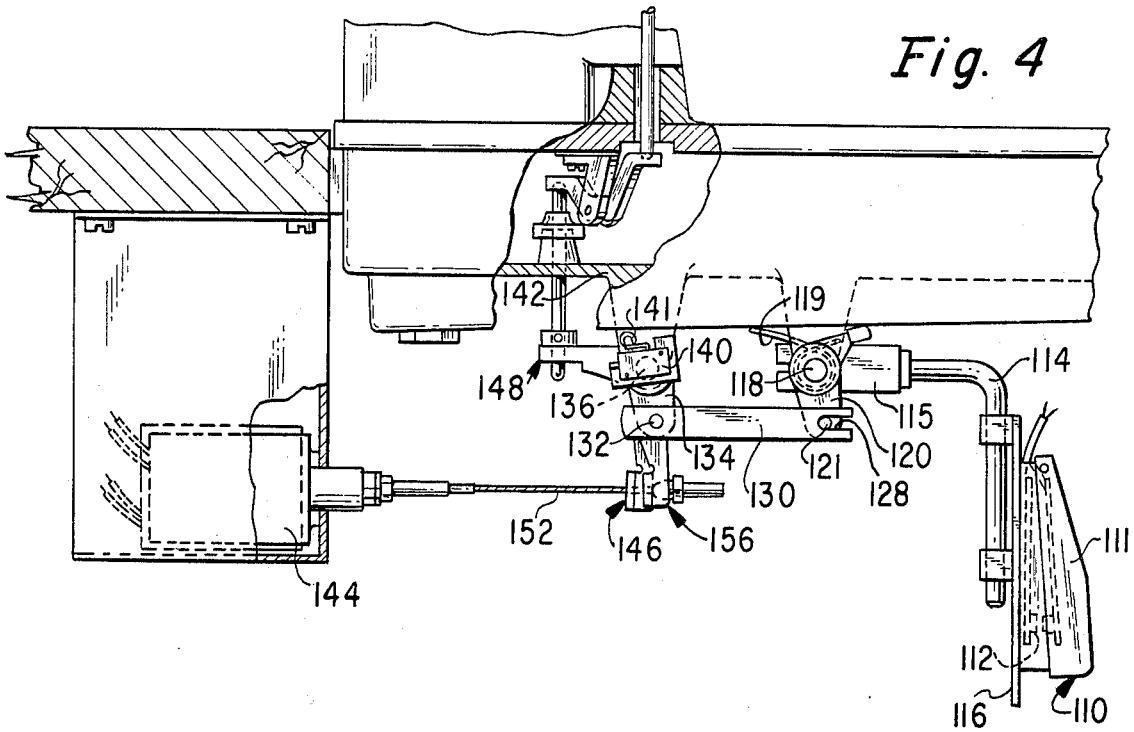
FIG. 4 is a rear elevational view of the bed portion of a sewing machine similar to that shown in FIG. 1 with, however, two rock shafts and provision for initial and final power lift.
Figure 5:
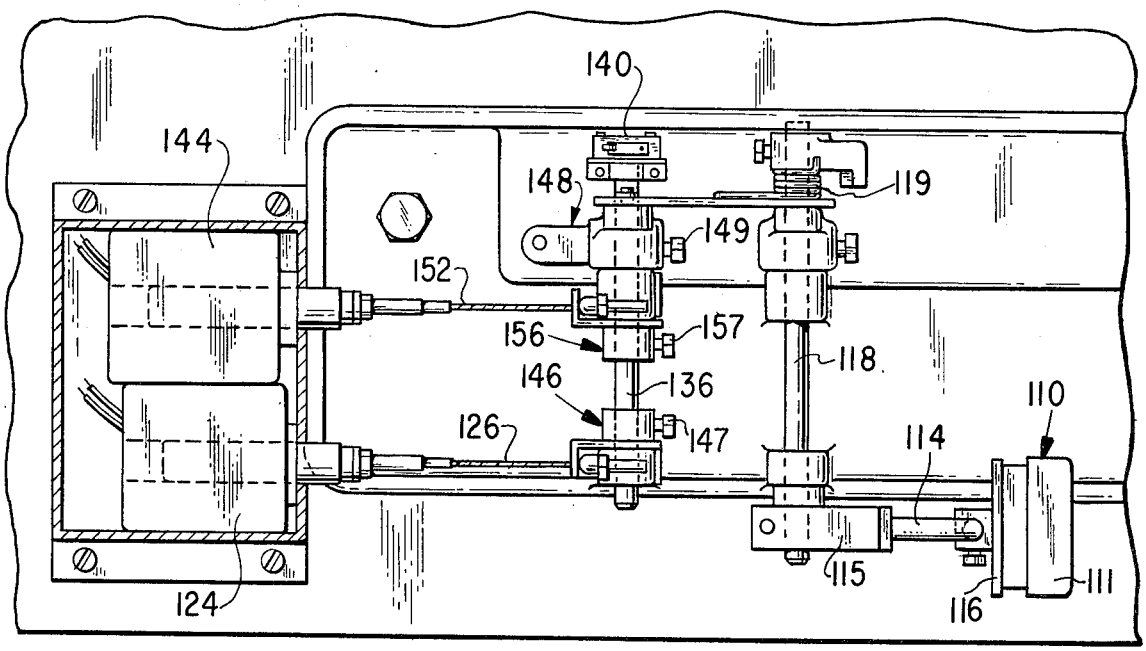
FIG. 5 is a bottom plan view of the sewing machine of FIG. 4 showing the two solenoids for implementing the initial and final lift of the presser foot.

Referring now to FIG. 4, there is shown a portion of a presser lifter arrangement which will provide the advantage of a small initial lift, but with electric actuators for both the initial and final lift in order to avoid operator fatigue. In FIG. 4 this additional improvement is shown in a two rock shaft arrangement although it will be evident that this improvement may be applied to a single rock shaft arrangement as shown in FIG. 1 just as easily. In FIG. 4, a switchable knee shift pad 110 is provided which is provided with internal contacts 112, a front cover 111 pivoted at 113 and a pad base 116. The base 116 of the knee shift pad 110 is fastened to a rod 114 which rod terminates in a clamp 115 carried by a first rock shaft 118. A torsion spring 119 is provided to maintain the rod 114 in an unactuated position when not subject to knee pressure on the knee shift pad 110. The first rock shaft 118 additionally supports a lever 120, which lever carries a pin 121 at the extremity thereof. Thus, first pressure of an operator's knee upon the switchable knee shift pad 110 will cause the front cover 111 thereof to deflect inwardly and actuate the contacts 112. Thus, a minimum travel solenoid 124 which is energized by means of the contacts 112 and a power circuit (not shown), will pull on pull cable 126 (see FIG. 5) and cause the presser foot 24 to be elevated a slight amount, sufficient, for example, to accomplish a darning operation which requires constant elevation of the presser foot. The pressure required by the knee of a sewing operator to deflect the front cover 111 and actuate the contacts 112 is not a sufficient force to overcome the torsion spring 119 and rotate the rod 114 and the rock shaft 118. An increase in pressure on the front cover 111 of the knee shift pad 110 sufficient to overcome the torsion spring 119 will rotate the rock shaft 118 and cause the pin 121 in the end of the lever 120 to press upon the bottom of a slot 128 in one end of a link 130 having its other end connected to a second pin 132 carried in the end of a second lever 134, which second lever is affixed to a second rock shaft 136. The second rock shaft 136 carries a snap action switch 140 in the same fashion as disclosed in FIGS. 3*a* and 3*b*, however the snap action switch 140 may be adjusted such that the follower 141 thereof has little or no clearance to the lubricant collecting pan 142 when the knee shift pad 110 is no actuated. Thus, slight rotation of the second rock shaft 136 will cause the snap action switch 140 to be rotated to actuate the contacts thereof and provide a circuit connection for a maximum travel solenoid 144 (see FIGS. 4 and 5) to a source of power.

Thus, first pressure upon a knee shift pad 110 will rotate a front cover 111 thereof against the compression spring (not shown) to actuate the contacts 112 thereof. When the contacts 112 are actuated, a circuit to a power source is provided for the solenoid 124, causing the solenoid to pull on pull cable 126 and draw a first actuator lever 146 connected to the second rock shaft 136 by a screw 147. The second rock shaft 136 will rotate and turn a foot lift lever 148 attached to the shaft by a screw 149. The foot lift lever 148 will be rotated by the minimum travel solenoid 124 sufficiently to raise the presser foot 24 of the sewing machine, as mentioned above, to permit a darning operation or a work positioning of the work fabric. Continued pressure on the knee shift pad 110 will, through its connection with link 130, cause the second rock shaft 136 to rotate and actuate the snap action switch 140. By actuation of the snap action switch 140, a circuit is provided from a power source to the maximum travel solenoid 144 which will pull on pull cable 152 to deflect a second actuator lever 156 attached by screw 157 to the second rock shaft 136. Rotation of the second rock shaft 136 thus achieved will rotate the foot lift lever 148 attached to the second rock shaft so as to elevate the presser foot 24 of the sewing machine to its maximum height. Rotation of the second rock shaft 136 by the maximum travel solenoid 144 will also rotate the second lever 134 causing the pin 132 thereof to move the link 130. Movement of the link 130 in this fashion has no effect on the first rock shaft 118 because the slot 128 in the link will not draw the pin 121 and thereby lever 120 affixed to the first rock shaft 118. Thus, a sewing operator may readily and easily obtain a first lift permitting a material repositioning or darning operation with little or no fatigueability. A very slight continued pressure on, and small additional motion of, the knee shift pad 110 will effect further elevation of the presser foot 24 to its maximum lift position.

I claim:

1. An improved presser lifting arrangement for a sewing machine having a frame, said frame including a work supporting bed, said frame supporting therein a presser bar and means for urging said presser bar towards said work supporting bed, said presser bar terminating in a presser foot for pressing a work fabric against said work supporting bed, said improved presser lifting arrangement comprising:

a knee shift pad;

means for supporting said knee shift pad beneath said sewing machine;

a first means responsive to a first pressure on said knee shift pad for raising said presser foot to a height above said work supporting bed sufficient to permit free movement of said work fabric beneath said presser foot; and second means other than said first means and responsive to an additional increment of pressure on said knee shift pad for lifting said presser foot to an upper limit for ready removal or insertion of said work fabric therebeneath, whereby said work fabric may be repositioned beneath said presser foot by actuation of said first means only.

2. An improved presser lifting arrangement for a sewing machine having a frame, said frame including a work supporting bed, said frame supporting therein a presser bar and means for urging said presser bar towards said work supporting bed, said presser bar terminating in a presser foot for pressing a work fabric against said work supporting bed, a rock shaft supported beneath said sewing machine bed, means extending from said presser bar to said rock shaft for implementing the raising and lowering of the presser foot, said improved presser lifting arrangement comprising:

a knee shift pad;

means for supporting said knee shift pad beneath said sewing machine;

a first means responsive to a first pressure on said knee shift pad for raising said presser foot to a height above said work supporting bed sufficient to permit free movement of said work fabric beneath said presser foot; and a second means other than said first means and responsive to an additional increment of pressure on said knee shift pad for lifting said presser foot to an upper limit for ready removal or insertion of said work fabric therebeneath, whereby said work fabric may be positioned beneath said presser foot by actuation of said first means only.

3. An improved presser lifting arrangement as claimed in claim 2 wherein said second means further comprises a snap action switch, means for adjustably supporting said snap action switch on said rock shaft, a fixed abutment adjacent said snap action switch for initiating actuation thereof after a selected rotation of said rock shaft, an actuating lever fixed to said rock shaft, and a solenoid operatably connected to said actuating lever and activated by said snap action switch to rotate said rock shaft for raising said presser foot to said upper limit by means of said implementing means.

4. An improved presser lifting arrangement as claimed in claim 3 wherein said supporting means includes a rod to which said knee shift pad is attached, and a member attached to said rock shaft to which said rod is attached.

5. An improved presser lifting arrangement as claimed in claim 4 wherein said first means further comprises internal switch switch contacts supported within said knee shift pad, and means responsive to said first pressure on said knee shift pad for actuating said internal switch contacts, a second actuating lever affixed to said rock shaft, and a second solenoid operatably connected to said second actuating lever and energized by said snap action switch to raise said presser foot to a height above said work supporting bed sufficient to permit free movement of said work fabric beneath said presser foot.

6. An improved presser lifting arrangement as claimed in claim 3 wherein said supporting means includes a second rock shaft, means for supporting said second rock shaft parallel to said rock shaft, means for imparting rotation of said second rock shaft to said rock shaft and for isolating motion of said rock shaft from said second rock shaft, wherein said first means further comprises internal switch contacts supported within said knee shift pad, and means responsive to said first pressure on said knee shift pad for actuating said internal switch contacts, a second actuating lever affixed to said rock shaft, and a second solenoid operably connected to said second actuating lever and activated by said internal switch contacts to raise said presser foot to a height above said work supporting bed sufficient to permit free movement of said work fabric beneath said presser foot.

* * * * *